US008873343B2

(12) United States Patent
Higgins

(10) Patent No.: US 8,873,343 B2
(45) Date of Patent: Oct. 28, 2014

(54) SIGNALING DEVICE AND METHOD OF USE IN CARING FOR PETS

(76) Inventor: Edward Jay Higgins, Devon, PA (US)

( * ) Notice: Subject to any disclaimer, the term of this patent is extended or adjusted under 35 U.S.C. 154(b) by 384 days.

(21) Appl. No.: 13/469,586

(22) Filed: May 11, 2012

(65) Prior Publication Data

US 2012/0287761 A1 Nov. 15, 2012

Related U.S. Application Data

(60) Provisional application No. 61/485,703, filed on May 13, 2011.

(51) Int. Cl.
*G04C 19/00* (2006.01)
*G04G 11/00* (2006.01)

(52) U.S. Cl.
CPC ..... *G04G 11/00* (2013.01)
USPC ..... 368/83; 368/109; 368/241

(58) Field of Classification Search
USPC ..... 368/82–84, 107–109, 239–241, 276, 368/278, 327
See application file for complete search history.

(56) References Cited

U.S. PATENT DOCUMENTS

| | | | | |
|---|---|---|---|---|
| 3,946,173 | A * | 3/1976 | Haber | 200/52 R |
| 4,878,107 | A | 10/1989 | Hopper | |
| 5,503,114 | A | 4/1996 | Castagna | |
| 5,706,257 | A * | 1/1998 | Rothman et al. | 368/10 |
| 6,155,700 | A | 12/2000 | Hsu | |
| D442,714 | S | 5/2001 | Warden | |
| 6,560,802 | B2 * | 5/2003 | Fujii | 5/639 |
| 6,845,735 | B1 | 1/2005 | Northrop et al. | |
| 7,551,523 | B2 * | 6/2009 | Larian | 368/274 |
| 8,218,401 | B2 * | 7/2012 | Wilson et al. | 368/108 |
| 2002/0180591 | A1 * | 12/2002 | Berstling et al. | 340/309.15 |
| 2005/0217595 | A1 | 10/2005 | Campbell | |
| 2008/0002528 | A1 * | 1/2008 | Andren et al. | 368/241 |
| 2009/0109798 | A1 * | 4/2009 | West et al. | 368/10 |
| 2009/0175033 | A1 | 7/2009 | Chien | |
| 2009/0175042 | A1 | 7/2009 | Chien | |
| 2012/0236690 | A1 * | 9/2012 | Rader | 368/10 |

OTHER PUBLICATIONS http://www.alibaba.com/product_gs/268023856/push_lamp_YS001_with remote control.html (Accessed Mar. 5, 2010 and Sep. 27, 2012).
http://www.asseenontvguys.com/browseproducts/Remote-Brite-Light.html (Accessed Mar. 5, 2010 and Sep. 28, 2012).
http://store.diyhut.com/taponliglika.html (Accessed Mar. 5, 2010 and Sep. 11, 2012).
http://www.garrettspecialties.com/tap-light-p-3644.html (Accessed Mar. 8, 2010 and Sep. 11, 2012.
http://www.solutions.com/jump.jsp?itemType=PRODUCT&itemID=10052 (Accessed Mar. 5, 2010 and Sep. 11, 2012).
http://www.nifty-stuff.com/led-tap-light.php (Accessed Mar. 8, 2010).
http://www.china-flashlight.com/products.asp?ClassID=3 (Accessed Mar. 8, 2010 and Sep. 27, 2012).

(Continued)

*Primary Examiner* — Sean Kayes
(74) *Attorney, Agent, or Firm* — Gerry J. Elman; Elman Technology Law, P.C.

(57) ABSTRACT

Devices having symbols or messages that are illuminated and darkened in accordance with a care-taking schedule for a pet, and methods for using the devices.

20 Claims, 16 Drawing Sheets

(56) References Cited

OTHER PUBLICATIONS http://www.petstore.com/ps_viewitem.aspx?idproduct=EU40030& child=EU40030&source=CashbackShopping&utm_source=bingcashback&utm_medium=cse&utm_campaign=bingcashback&utm_content=EU40030&tab=2 (Accessed Mar. 17, 2010 and Sep. 11, 2012).

https://www.theanimalrescuesite.com/store/ars/item/33700/dog-bone-flashing-pet-safety-light (Accessed Mar. 17, 2010 and Sep. 28, 2012).

http://www.amazon.com/Wireless-LED-Tap-Light-Timer/dp/B002BK1YT8 (Accessed Mar. 10, 2010 and Sep. 11, 2012).

http://www.greendepot.com/greendepot/product.asp?prod_name=LED+Touch+Light+with+Timer&pf_id=LEDTOUCH (Accessed Mar. 10, 2010 and Sep. 27, 2012).

http://www.garritylites.com/page51.html (Accessed Mar. 10, 2010 and Sep. 27, 2012).

http://www.alibaba.com/product-gs/276052174/umbrella_light_garden_lamp_.html (Accessed Mar. 5, 2010 and Sep. 27, 2012).

* cited by examiner

SIGNALING DEVICE AND METHOD OF USE IN CARING FOR PETS

CROSS-REFERENCE TO RELATED APPLICATIONS

This application claims the benefit under 35 U.S.C. §119 (e) of U.S. Provisional Application 61/485,703 filed May 13, 2011, the entire contents of which are incorporated herein by reference.

TECHNICAL FIELD

The present disclosed subject matter relates to caring for pets according to a schedule with the aid of a signaling device. More particularly, the present subject matter relates to devices having symbols or messages that are illuminated and darkened in accordance with a care-taking schedule for a pet.

BACKGROUND

Many households in the United States and abroad include at least one pet, a domesticated animal that is kept as a companion. Unlike most other household members, pets are reliant on humans to actively provide for their exercise, food, and water. As with humans, pets must eat on a schedule to maintain a healthy diet. However, unlike humans, pets by and large are unable to communicate verbally, so when their bodily needs go unanswered, it can be difficult or impossible to communicate this fact to their caretakers. In certain cases, pets and their owners may have established basic signals to communicate such needs. However, another issue arises, which is that a pet, like a human, may wish to eat more than is healthy for his body. In such cases, a pet may signal to one caretaker that he has not been fed according to the established schedule, when in fact another caretaker has already fed him. This can result in over eating and obesity, which can lower the happiness of the animal, lead to medical complications, and ultimately, a shorter life.

In a busy household, two or more people may be tasked with feeding the animals. Often, these pet caretakers of the household may not have the opportunity to communicate with one another on every day of the week and if they do, may spend the limited time discussing other matters. While pet owners may care deeply for their animal, their pet's eating schedule may not be at the forefront of their minds and they may forget to mention whether they fed the family pet or not. This results in uncertainty for another caretaker of the family trying to determine whether the pet has already been fed. Considering the often hectic lifestyle of people, feeding a pet is often one of the last things a pet owner does on the way out the door to work. Often, the owner will find himself in a rush to get to work and without ample time to write a note with the date and time about whether the pet was fed or not. Without date and time information, such notes are of no value and can easily lead to miscommunication among the caretakers of the pets. Other signaling means are available, such as turning a light on or off. Again, however, signaling means is of little or no value without the additional information of when the light was turned on or off.

The following prior art references are pertinent to the presently disclosed subject matter:

U.S. Pat. No. 4,878,107 to Hopper issued Oct. 31, 1989 ("Hopper")

This patent discloses a touch-sensitive light emitting diode that has switching means positioned within the plastic dome. The diode provides a visual indication of the state of the switching means.

U.S. Pat. No. 6,155,700 to Hsu issued Dec. 5, 2000 ("Hsu").

This patent discloses a touch light that can be used as an illumination device or warning indication at night.

U.S. Pat. No. 5,503,114 to Castagna issued Apr. 2, 1996 ("Castagna")

This reference discloses a direct pet communicating device to permit individuals coming in contact with the pet to instantly and continuously be aware of the pet's specific and/or special needs even in the absence of the owner or the pet's caretaker. The device is a specially designed message holder, attachable to a collar, whereupon messages can be written. The message holder may further comprise reflector tape for visualization in a darkened environment.

U.S. Pat. No. 6,845,735 to Northrop et al issued Jan. 25, 2005 ("Northrop")

This patent discloses a pet feeder comprising a sensor which sends a signal to a microcontroller to activate a warning light to alert the user that the food reservoir should be replenished.

U.S. Pat. No. 7,562,995 to Levine issued Jul. 21, 2009 ("Levine")

This reference discloses a battery-powered, adjustable lighting device containing one or more light emitting diodes ("LEDs").

U.S. D442,714 to Warden issued May 22, 2001 ("Warden")

This U.S. design patent discloses an ornamental design for a dog-bone-shaped light for a pet collar.

U.S. Appl. 20090175033 to Chien published Jul. 9, 2009 ("Chien 1")

This published U.S. patent application discloses a touch light (night light) with a laser or hologram optics-means for displaying a message, an image, or a logo.

U.S. Appl. 20090175042 to Chien published Jul. 9, 2009 ("Chien 2")

This published U.S. patent application discloses a night light with shaped pin-holes to project images, messages, and logos onto the surrounding environment, for example, on ceilings, walls, floors, and other desired surfaces.

U.S. Appl. 20050217595 to Campbell published Oct. 6, 2005 ("Campbell")

This reference discloses a pet care display board for reminding someone that pet care has been accomplished or needs to be accomplished.

SUMMARY OF THE INVENTION

As will be clear from the present disclosure, the inventive device and method disclosed herein works equally well for one pet or multiple pets. Accordingly, the word "pet" as it appears herein should be interpreted to mean one or more pets. Further, it should be understood that the terms "animal" and "pet" are used interchangeably herein. It should also be clear that the terms "human," "owner," "pet owner," and "caretaker" are used interchangeably throughout this disclosure. Additionally, it should be appreciated that "household" is not limited to the area within a house, but any property used as a dwelling for humans and/or pets.

The present invention provides pet owners a way to easily communicate to one another that a pet has been fed. It also helps pet owners keep track of when the pet should be fed again. Included in the present subject matter is a signaling device having a symbol or message signifying that a pet has been fed, or alternatively, that the pet needs to be fed. The message or symbol is backlit by one or more light emitting diodes ("LEDs"). Simply touching the message or symbol activates the backlighting. The device would typically be located in a pet's feeding area and can be attached to most surfaces with adhesive tape backing.

The invention also includes a method for using the device to maintain a feeding schedule for a pet and to signal to other caretakers whether the pet is due to be fed again. The quick one-touch operation for the device would become a habit of the caregivers and become a routine.

The signaling device of the presently disclosed invention desirably includes an opaque housing, preferably made of plastic. The housing may be of any color and shape. However, given that the function of the device is to help pet owners coordinate their efforts to maintain a feeding schedule for a pet, the housing is preferably of a shape that is symbolic of this effort. Additionally, and of special value in a household with multiple types of animals that are kept as pets, the housing is desirably shaped to be suggestive of the type of pet whose feeding schedule it helps coordinate. For example, where the type of animal is a dog, the housing could be shaped like a dog bone. For a horse, the housing is shaped like a horse shoe. Where the animal is a reptile, the housing could be in the shape of a turtle or other reptile. For a bird, the housing could include a representation of a bird. For cats, fish, rabbits, and rodents, the housing is desirably shaped as the face or body of a cartoonish animal of that sort. These are all preferred embodiments and are not limiting on the possibilities for other various shapes, within the scope of the present invention.

Included in the housing is a translucent button that contains a short message indicating that a type of pet in the household has been fed or needs to be fed, depending on the particular embodiment. For example, in a preferred embodiment for dogs, the message is desirably "Dogs R Fed" or "Dogs Are Fed." Also depending on the embodiment, the translucent button may include additional features or markings illustrative of the type of animal that the device relates to. For example, in an embodiment for cats, the translucent button could show a cartoon-like face of a cat, in addition to the message "Cats R Fed" or "Cats Are Fed."

Inside the housing are battery compartments for batteries, a circuit board, at least one push-button switch, at least one light emitting diode ("LED"), a micro chip, and a timer control. Preferably, the device is powered by four AA batteries. In other embodiments, different numbers and types of batteries are used. In alternative embodiments, the device is plugged into an electrical outlet and is equipped with an appropriate AC adaptor instead of battery compartments. The benefit of this alternative embodiment is that there is never a concern that the power will run out. In yet other embodiments, the device is capable of being powered by battery and/or an electrical outlet and accordingly is equipped with battery compartments and a plug. Further embodiments include solar cells to allow the device to be powered by light. The push-button switch is located behind the translucent button, so that the force of touching or tapping the button is transferred to the push-button switch, causing it to turn on or off the power to the LEDs. The LEDs are also directly behind the translucent button so that, when illuminated, the light may pass through the translucent button and illuminate the message, symbol, or other markings on the translucent button. The LEDs and the translucent button may be of any color. All of the electronics are incorporated into the circuit board. A microchip, microcontroller, or logic unit (hereinafter "microchip") operates in tandem with the timer control, as discussed below.

On one side of the housing is the aforementioned timer control. The timer control is used for setting the interval between scheduled feedings for the type of pet that the device pertains to. The interval setting controls how long the light stays on or off, depending on the embodiment, after the translucent button has been touched by a caretaker after feeding a pet. Depending on the type of animal, the optimal interval between feedings differs. For example, fish might be fed once a day whereas dogs or cats are fed two or more times per day. In certain embodiments, the timer control is a slidable switch that is capable of being slid to a setting for one of a number of intervals, such as 2 hours, 4 hours, 6 hours, 12 hours, 24 hours, or another interval. In certain embodiments, there is also a setting for keeping the light on or off indefinitely. In other embodiments, the time control is a dial rather than a slidable switch. The microchip is configured to activate and/or deactivate the LEDs in accordance with the interval set on the timer control. In preferred embodiments, if the translucent button is touched again, the light changes to the opposite state, off or on, irrespective of the interval setting. In these embodiments, the microchip is configured to allow such functionality. In certain embodiments, a decal bearing the name of the pet is affixed to the device, preferably on the translucent button. In further embodiments, the translucent button incorporates a liquid crystal display ("LCD") which is controlled by the microchip to display the name of the pet.

The presently disclosed invention includes a method of using the above-discussed device for maintaining a feeding schedule for a pet. The method includes first looking at the device and determining whether it shows an illuminated message indicating that the pet has been fed. If the device does not show an illuminated message indicating that the pet has been fed, feeding the pet and then touching the device causes the message indicating that the pet has been fed to illuminate. If the message is already illuminated, then one may return and feed the pet at a later time.

In an alternative embodiment, the method includes first looking at the device and determining whether it shows an illuminated message indicating that the pet has not been fed. If the device shows an illuminated message indicating that the pet has not been fed, feeding the pet and then touching the device, causing the message indicating that the pet has not been fed to darken. If the message is already darkened, then one may return at a later time to feed the pet.

Additional steps in the aforesaid embodiments of the method include first inserting batteries or plugging the device into an electrical outlet, setting the feeding interval with the timer control, and selecting a housing shape to correspond to the type of pet the device relates to.

Based on the above discussion of the device in its various possible forms and the corresponding methods of using it, the following are aspects of the invention.

An aspect of the invention is a signaling device for helping at least one caretaker maintain a feeding schedule for at least one pet comprising:

a housing having a front face;

a translucent button accessible at the front face of the housing;

a circuit board located within the housing;

a microchip located within the housing and connected to the circuit board;

at least one light emitting diode located within the housing and connected to the circuit board;

at least one push-button switch located within the housing and connected to the translucent button and the circuit board; and at least one timer control secured within the housing but accessible from outside the housing, the timer control being connected to the circuit board.

A further aspect of the invention is the signaling device as discussed above, wherein the front face of the housing includes an opening and the translucent button is secured within the housing and fills the opening in the front face of the housing.

A further aspect of the invention is the signaling device as discussed above, wherein the translucent button includes a message, symbol, or markings relating to a type of pet and/or feeding of the pet.

A further aspect of the invention is the signaling device as discussed above, wherein the housing is of a shape indicative of a type of pet.

A further aspect of the invention is the signaling device as discussed above, further comprising at least one battery compartment in the housing.

A further aspect of the invention is the signaling device as discussed above, further comprising an electrical plug connected to the circuit board.

A further aspect of the invention is the signaling device as discussed above, wherein the housing is opaque and made of plastic.

A further aspect of the invention is the signaling device as discussed above, wherein the timer control is a slidable switch.

A further aspect of the invention is the signaling device as discussed above, wherein the timer control is a dial.

A further aspect of the invention is the signaling device as discussed above, wherein the microchip turns on the at least one light emitting diode according to a setting on the timer control.

A further aspect of the invention is the signaling device as discussed above, wherein the microchip turns off the at least one light emitting diode according to a setting on the timer control.

A further aspect of the invention is the signaling device as discussed above, wherein the microchip turns on or off the at least one light emitting diode when the translucent button is touched.

A further aspect of the invention is the signaling device as discussed above, wherein the housing further comprises a back face having adhesive tape connected thereto.

Another aspect of the invention is a method of using the above-discussed signaling device for maintaining a feeding schedule for a pet comprising:

(a) looking at the device and determining whether it shows an illuminated message indicating that the pet has been fed; and (b) if the device does not show an illuminated message indicating that the pet has been fed, feeding the pet and then touching the device, causing the message indicating the that pet has been fed to illuminate, and (c) if the device shows an illuminated message indicating that the pet has been fed, returning to the device at a later time and starting over at step (a).

Another aspect of the invention is a method of using the above-discussed signaling device for maintaining a feeding schedule for a pet comprising:

(a) looking at the device and determining whether it shows an illuminated message indicating that the pet has not been fed; and (b) if the device shows an illuminated message indicating that the pet has not been fed, feeding the pet and then touching the device, causing the message indicating that the pet has not been fed to darken, and (c) if the device shows an unilluminated or darkened message, returning to the device at a later time and starting over at step (a).

A further aspect of the invention is any of the methods discussed above, further comprising:

before step (a), inserting batteries or plugging the signaling device into an electrical outlet.

A further aspect of the invention is any of the methods discussed above, further comprising:

before step (a) setting a feeding interval with the timer control.

A further aspect of the invention is any of the methods discussed above, wherein step (a) further comprises:

determining which type of pet the device relates to based on the shape of the housing.

BRIEF DESCRIPTION OF THE DRAWINGS

Attention is now directed to the drawing figures, where like or corresponding numerals indicate like or corresponding components. In the drawings.

DETAILED DESCRIPTION OF THE DRAWINGS

Figure 1:
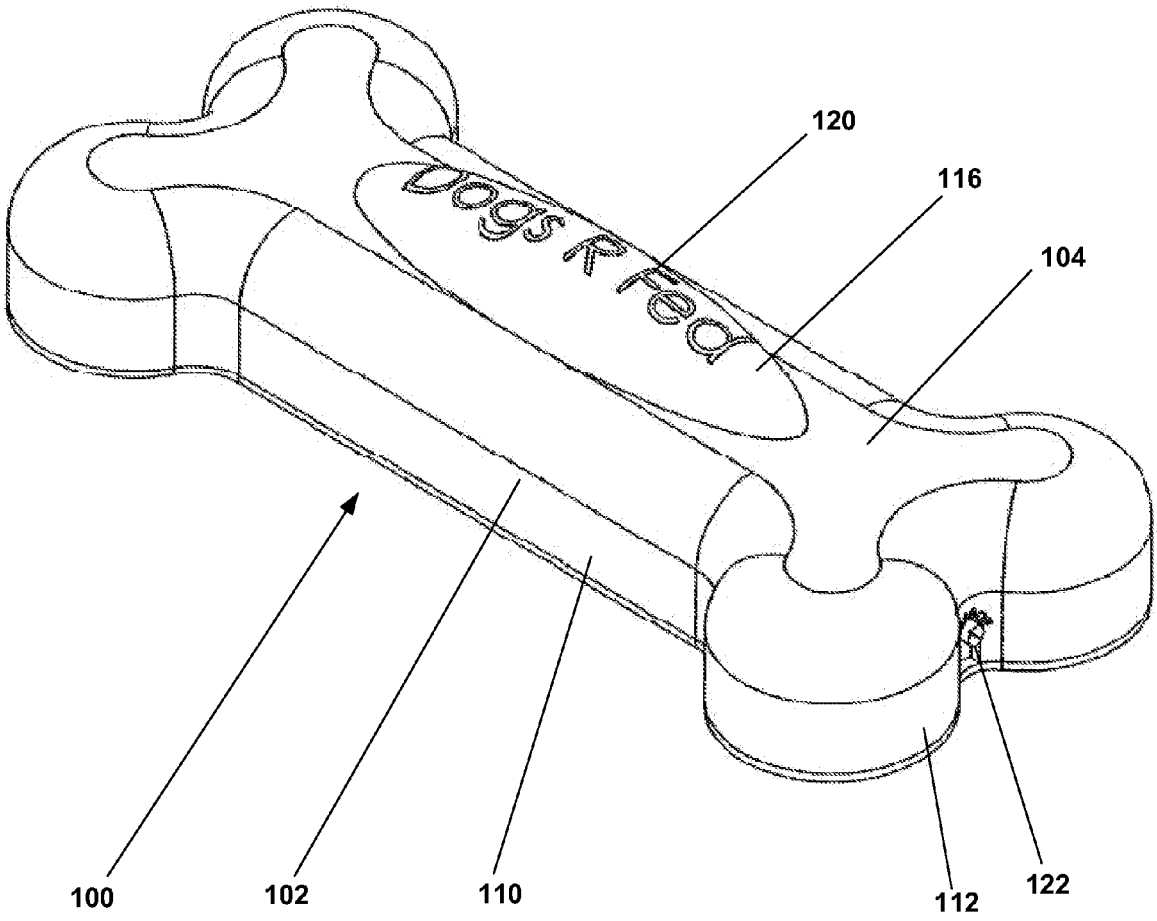
FIG. 1 is a perspective view of a first embodiment of a signaling device according to the invention wherein the housing is in the shape of a dog bone.

FIG. 1 is a perspective view of a first embodiment of a signaling device 100 according to the invention wherein the housing 102 is in the shape of a dog bone. Visible in this drawing are the front face 104, bottom side 110, right side 112, translucent button 116, a message 120 saying "Dogs R Fed" located on the translucent button 116, and a timer control 122. A caretaker using the signaling device 100 presses the translucent button 116 after feeding one or more household pets, in this case one or more dogs. Upon being pressed, the translucent button 116 is illuminated for a period of time set by timer control 122.

Figure 2:
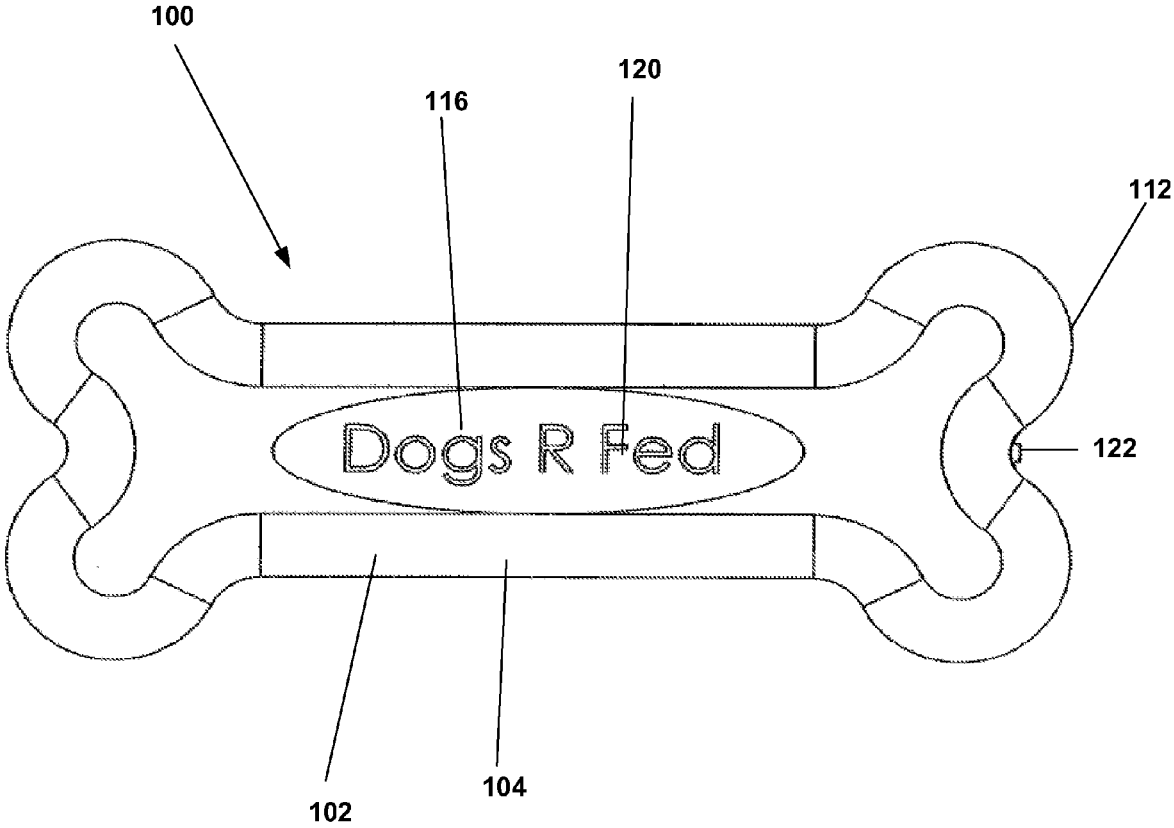
FIG. 2 is a plan view of the front face of the first embodiment of the signaling device.

FIG. 2 is a plan view of the front face 104 of the first embodiment of the signaling device 100. From this view, the housing 102 is clearly in the shape of a dog bone and the message 120 on the translucent button 116 accordingly relates to the feeding of dogs. In the right side 112 of the housing 102 is timer control 122.

Figure 3:
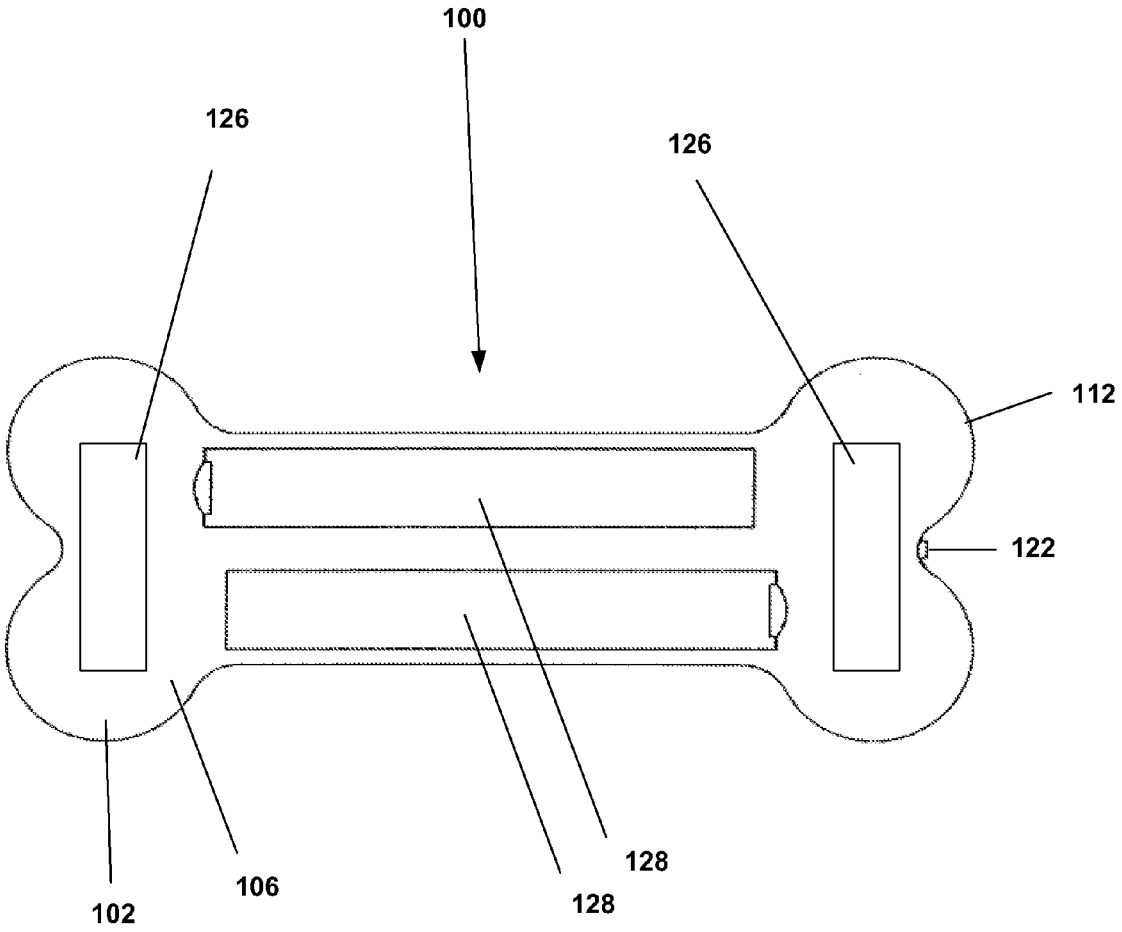
FIG. 3 is a plan view of the back face of the first embodiment of the signaling device.

FIG. 3 is a plan view of the back face 106 of the first embodiment of the signaling device 100. Protruding from the right side 112 of the housing 102 is timer control 122. This embodiment of the signaling device 100 is powered by batteries. As can be seen, the battery compartment doors 128 are located on the back face 106 of the signaling device 100. In addition, this embodiment includes adhesive tape strips 126 for conveniently mounting the signaling device 100 to a wall or other surface near a pet feeding area.

Figure 4:
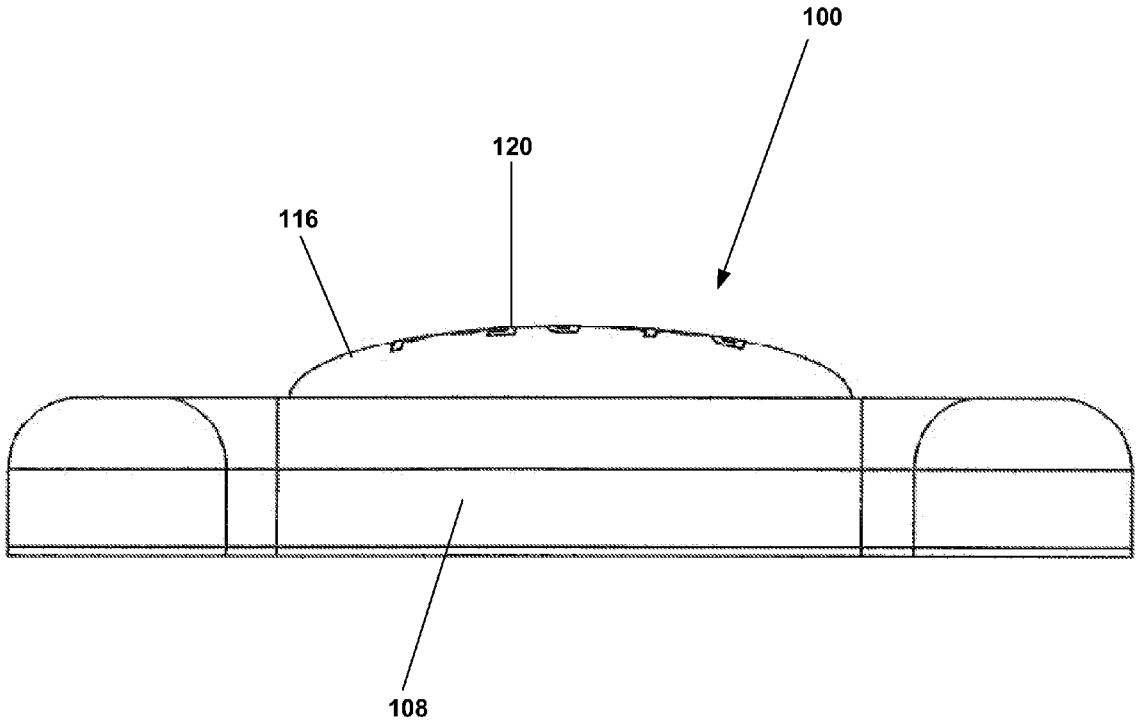
FIG. 4 is an elevation view of the top side of the first embodiment of the signaling device.

FIG. 4 is an elevation view of the top side 108 of the first embodiment of the signaling device 100. The translucent button 116 in this embodiment has a dome shape. Also, partially visible is message 120 on the translucent button 116.

Figure 5:
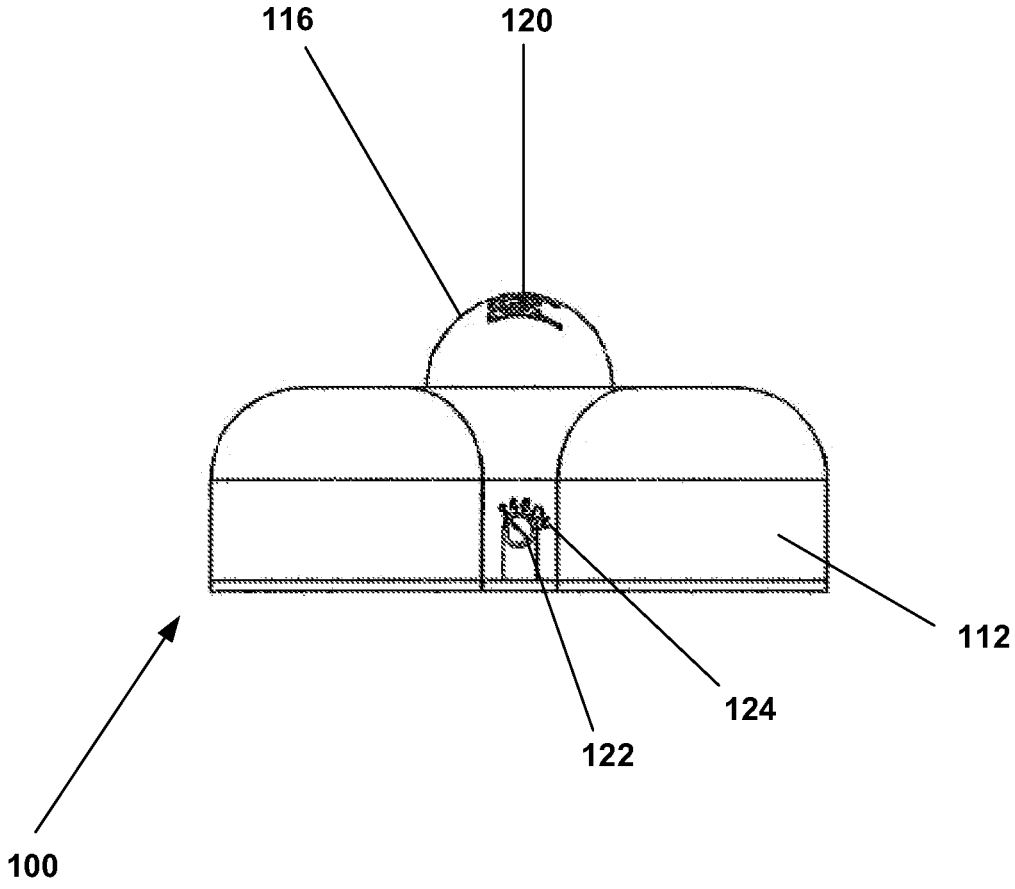
FIG. 5 is an elevation view of the right side of the first embodiment of the signaling device.

FIG. 5 is an elevation view of the right side 112 of the first embodiment of the signaling device 100. Again, the translucent button 116 is visible, with message 120 stating "Dogs R Fed" partially visible as well. From this view, timer control 122, which in this embodiment is a dial, can be seen head-on. Also shown are indicators 124 for the multiple available settings that the timer control 122 can be adjusted to. In this embodiment, the indicators are "2," "4," "6," and "on." The first three settings correspond to the number of hours that the translucent button 116 stays illuminated after a caretaker touches the button 116. The last indicator, "on," signifies that the translucent button 116 will stay illuminated indefinitely instead of turning off after a set time period. As mentioned previously, regardless of the setting on the timer control 122, the translucent button 116 will darken at any time if it is pressed when it is illuminated.

Figure 6:
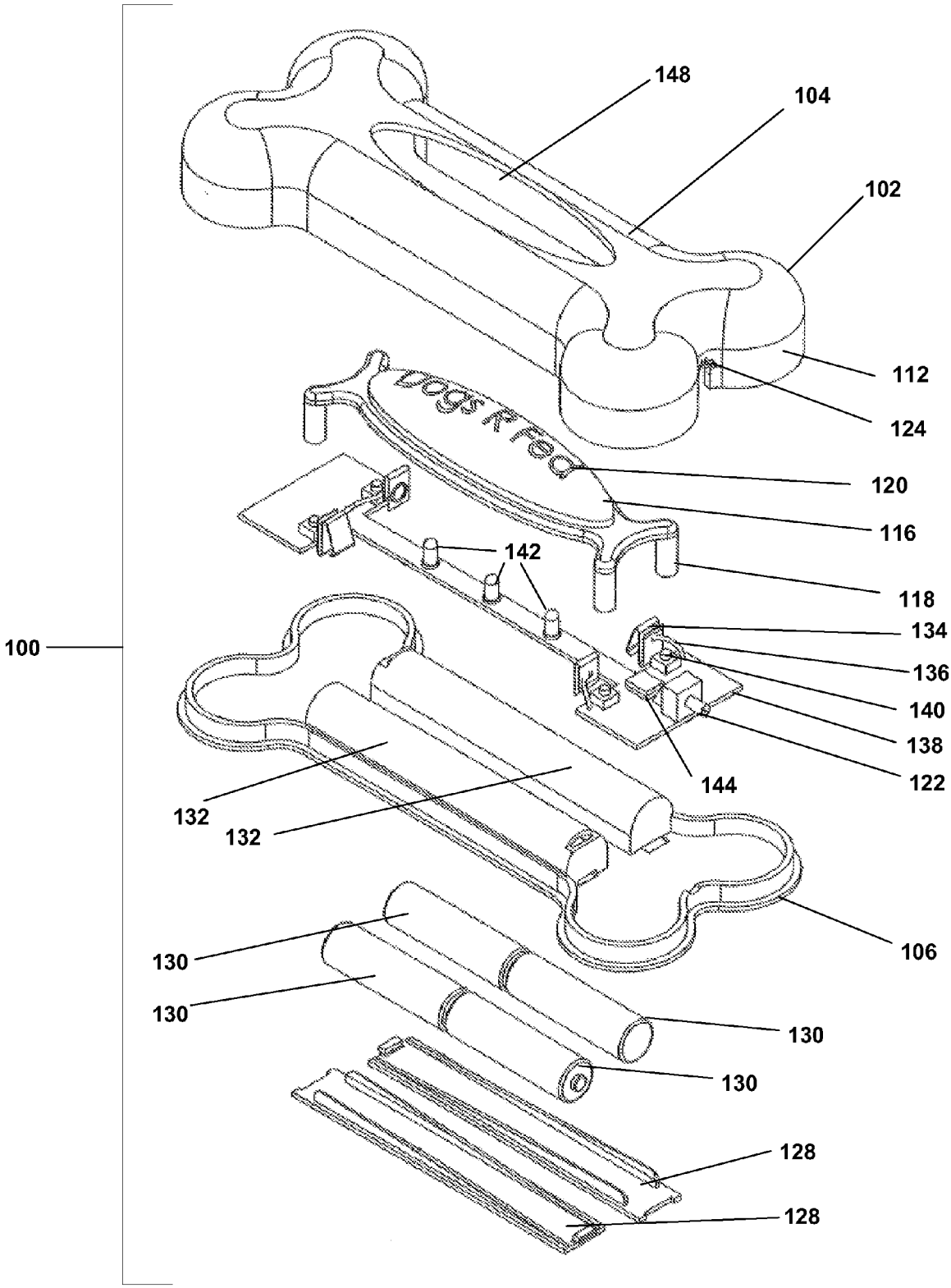
FIG. 6 is an exploded perspective view of the first embodiment of the signaling device.

FIG. 6 is an exploded perspective view of the first embodiment of the signaling device 100. Starting from the top of the view, the front face 104 of housing 102 is in the shape of a dog bone. The front face 104 includes an opening 148 through which translucent button 116 protrudes when the device 100 is assembled. The right side 112 of the signaling device 100 includes indicators 124 representing the various settings for timer control 122. Moving down in the view, the translucent button 116 is disposed below the front face 104 of the housing 102. The portion of translucent button 116 bearing the "Dogs R Fed" message 120 fits through opening 148 of the front face 104. A plurality of legs, one of which is indicated in the view as 118, support the translucent button 116 within the signaling device 100.

Each leg 118 is disposed atop either a spring or a push button switch, one of which is identified as item 140. In this embodiment, each leg 118 is supported by a push button switch 140. Alternative embodiments may employ only one push button, with springs in place of the other push buttons. A push button switch 140 signals microchip 144 that the translucent button 116 has been pressed. The microchip 144 monitors the amount of time that has elapsed since the translucent button 116 was last pressed and darkens light emitting diodes ("LEDs") 142 when the elapsed time is equal to the setting of timer control 122. The microchip 144 will also override this functionality and simply switch the state of the LEDs 142 to darkened or illuminated each time the translucent button 116 is pressed. Also visible on this layer of the exploded view are battery terminals 134 and battery terminal wires 136. These items provide power to the electrical components of this battery powered embodiment of the signaling device 100. All electrical components are electrically connected to circuit board 138.

Moving to the next layer of the signaling device 100, battery compartments 132 are visible. This layer of the signaling device 100 contains the section of the housing 102 that contains the back face 106, which is more clearly visible in FIG. 3. This embodiment of the signaling device 100 is powered by four AA batteries 130. Battery compartment doors 128 secure batteries 130 into battery compartments 132.

Figure 7:
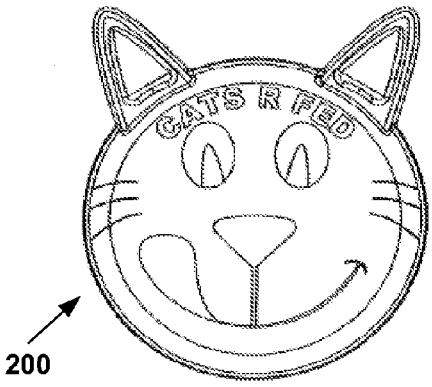
FIG. 7 is a plan view of the front face of a second embodiment of the signaling device, wherein the housing is in the shape of a cat face.
Figure 8:
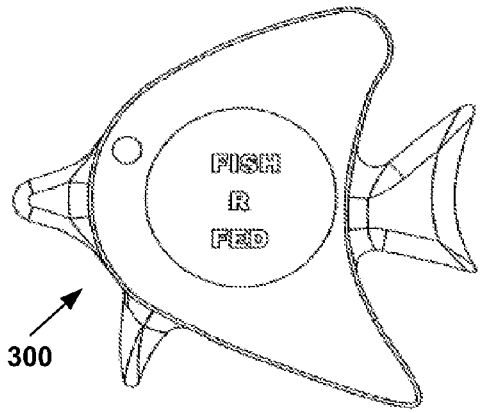
FIG. 8 is a plan view of the front face of a third embodiment of the signaling device, wherein the housing is in the shape of a fish.
Figure 9:
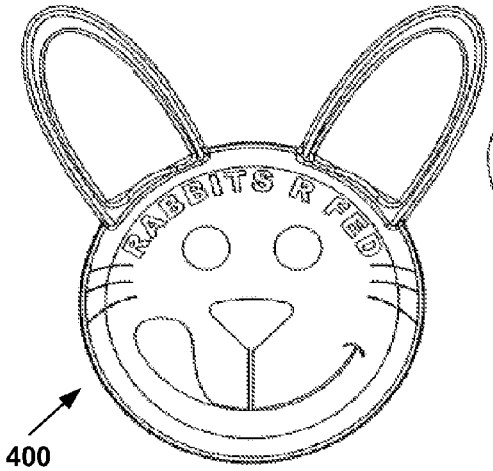
FIG. 9 is a plan view of the front face of a fourth embodiment of the signaling device, wherein the housing is in the shape of a rabbit face.
Figure 10:
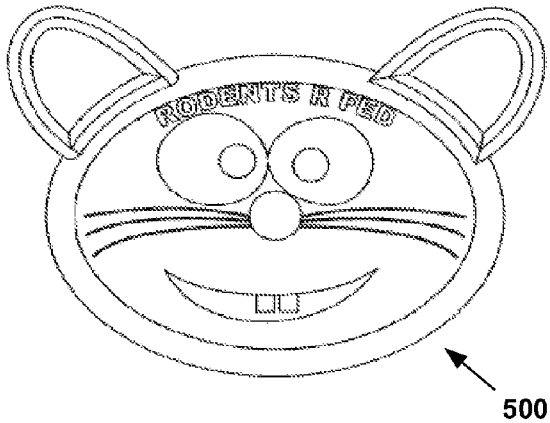
FIG. 10 is a plan view of the front face of a fifth embodiment of the signaling device, wherein the housing is in the shape of a rodent face.
Figure 11:
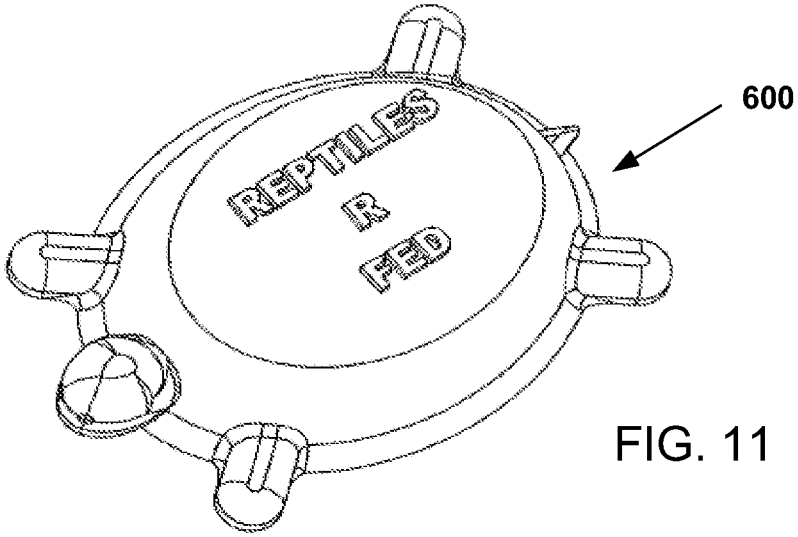
FIG. 11 is a perspective view of a sixth embodiment of the signaling device, wherein the housing is in the shape of a turtle.
Figure 12:
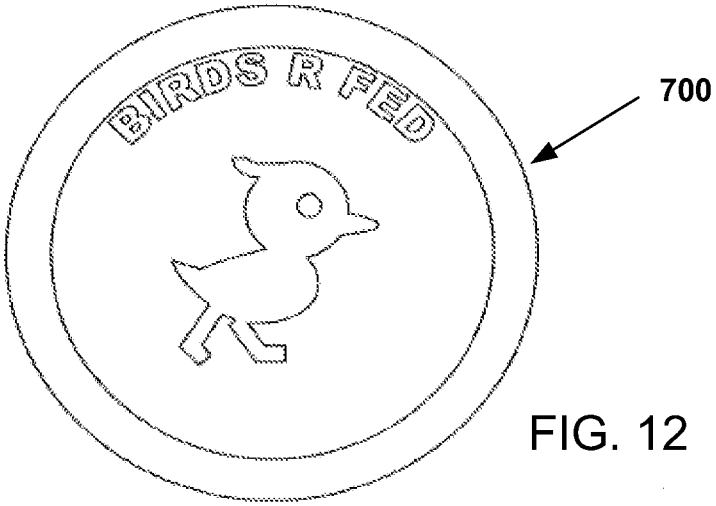
FIG. 12 is a plan view of a seventh embodiment of the signaling device, wherein the housing is circular and the translucent button includes a symbol of a bird.
Figure 13:
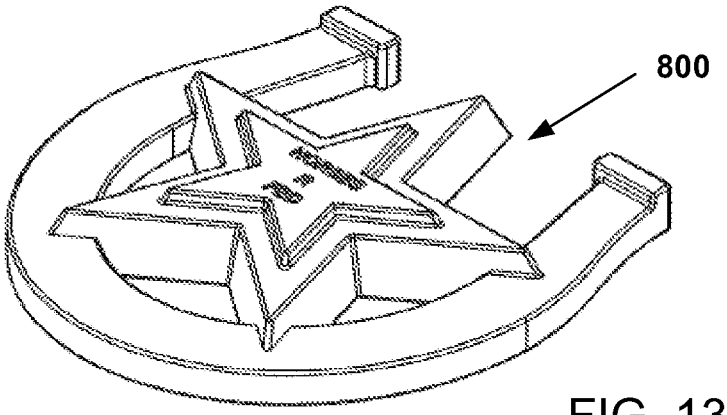
FIG. 13 is a perspective view of an eighth embodiment of the signaling device, wherein the housing is in the shape of a horseshoe with a star in the center of it.

The presently disclosed signaling device preferably contains markings or is of a shape that represents the type of animal that it is used in conjunction with. Accordingly, FIGS. 7 through 13 disclose exemplary embodiments of the signaling device, each with a shape and/or markings corresponding to one of a variety of animal types. FIG. 7 is a plan view of the front face of the second embodiment of the signaling device 200 in the shape of and containing markings of a cat face. FIG. 8 is a plan view of the front face of a third embodiment of the signaling device 300 in the shape of and containing markings of a fish. FIG. 9 is a plan view of the front face of a fourth embodiment of the signaling device 400 in the shape of and containing markings for a rabbit face. FIG. 10 is a plan view of the front face of a fifth embodiment of the signaling device 500 in the shape of and containing markings for a rodent face. FIG. 11 is a perspective view of a sixth embodiment of the signaling device 600 in the shape of a turtle and containing markings for a reptile. FIG. 12 is a plan view of a seventh embodiment of the signaling device 700 in a circular shape and including a symbol of a bird. FIG. 13 is a perspective view of an eighth embodiment of the signaling device 800 in the shape of a horseshoe with a star in the center of it.

Figure 14:
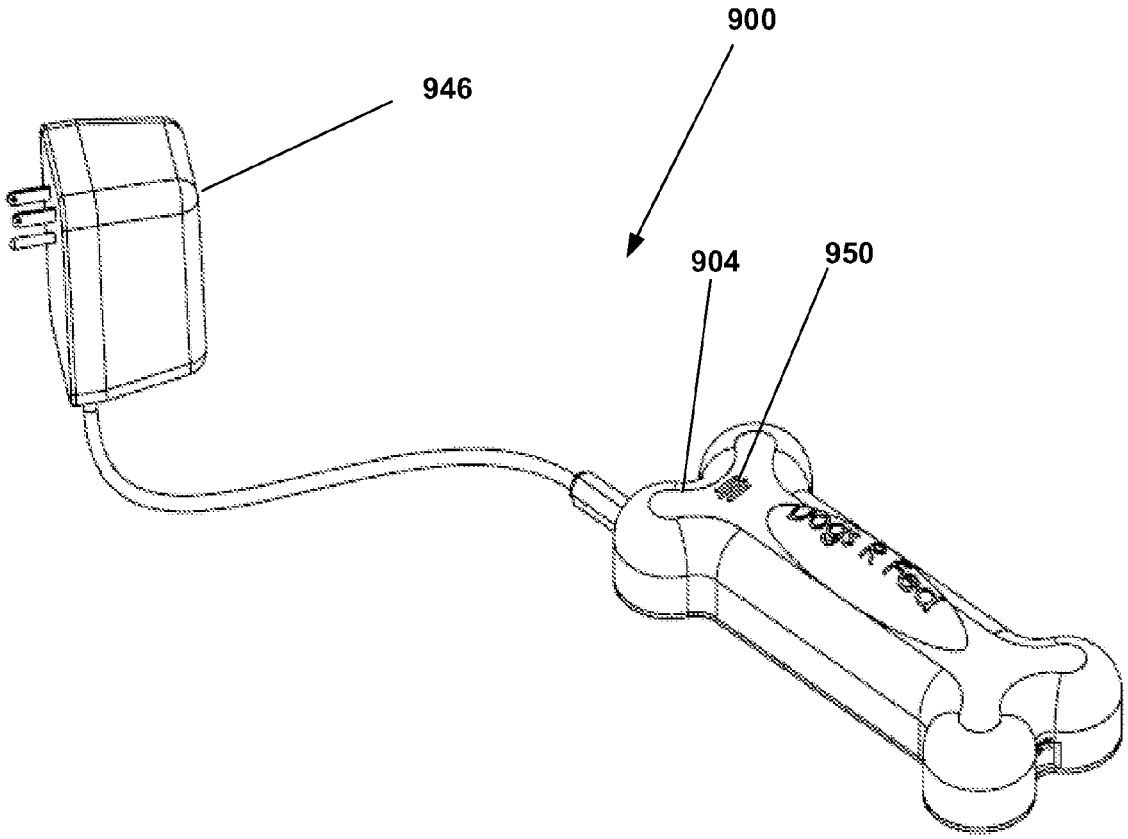
FIG. 14 is a perspective view of a ninth embodiment of a signaling device according to the invention wherein the housing is in the shape of a dog bone and the device includes an AC adaptor and an audible alarm.
Figure 15:
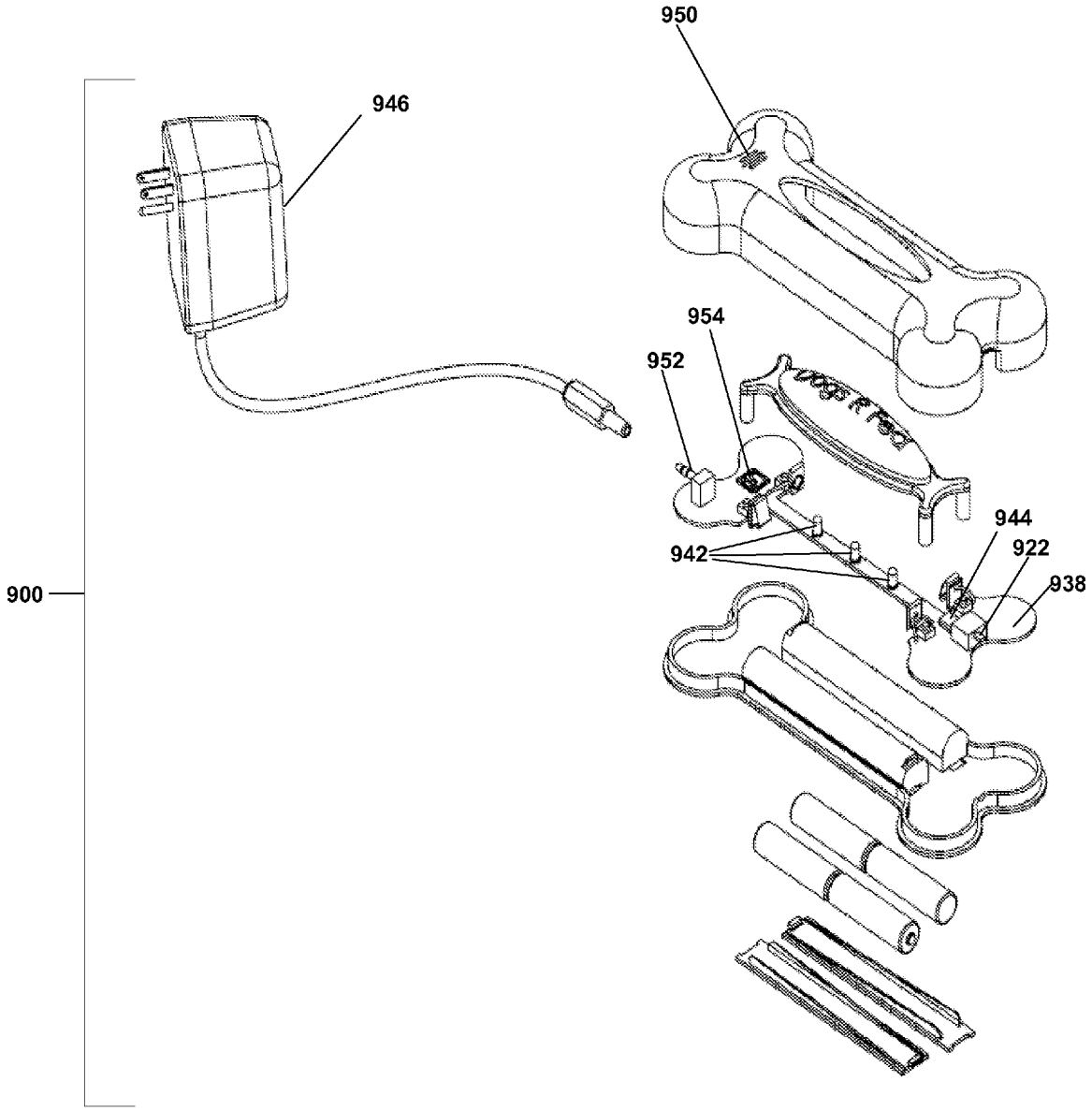
FIG. 15 is an exploded perspective of the ninth embodiment of a signaling device according to the invention wherein the housing is in the shape of a dog bone and the device includes an AC adaptor and an audible alarm.

FIG. 14 is a perspective view of a ninth embodiment of a signaling device 900 according to the invention wherein the housing is in the shape of a dog bone and the device includes an AC ("alternating current") adaptor 946 and an audible alarm 954, visible in FIG. 15. The front face 904 includes slots 950 through which sound from the audible alarm 954 emanates when the audible alarm is activated. Unlike previously discussed embodiments, wherein the translucent button darkens when a pet is scheduled to be fed again, this embodiment of the device 900 is configured to illuminate the translucent button and activate an audible alarm 954 when the pet is scheduled to be fed. When the audible alarm is sounding, certain embodiments may also cause LEDs 942, visible in FIG. 15, to flash. In these embodiments, the LEDs 942 are preferably red. The AC ("alternating current") adaptor 946 provides power to the device when plugged into a corresponding electrical socket.

FIG. 15 is an exploded perspective view of the ninth embodiment of a signaling device 900 according to the invention wherein the housing is in the shape of a dog bone and the device includes an AC ("alternating current") adaptor 946 which connects with external power receiver 952. The device 900 also includes an audible alarm 954. As with the first embodiment, all electrical components in the device 900 are connected to a circuit board. The audible alarm 954 is controlled by a microchip 944 to emit a beeping sound, a verbal message, or other audible cue for a caretaker to feed the pet when the pet is scheduled to be fed again. This embodiment of the device 900 includes a slidable timer control switch 922 instead of a dial. As with previously-discussed embodiments, the electrical components are connected to a circuit board 938. The discussion of the corresponding items in FIG. 6 applies equally to the remaining items shown in FIG. 15.

Figure 16:
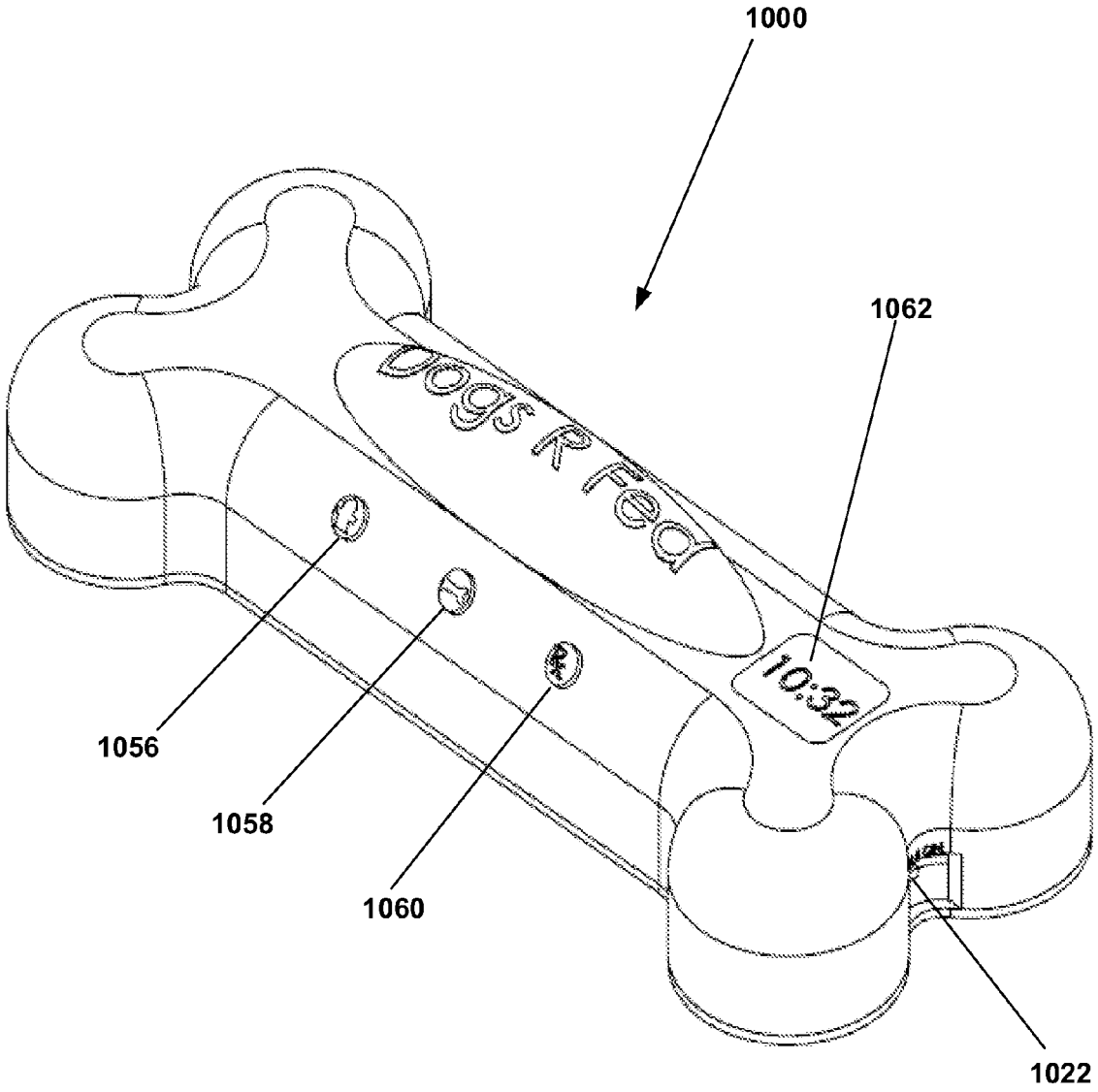
FIG. 16 is a perspective view of a tenth embodiment of a signaling device according to the invention wherein the housing is in the shape of a dog bone and the device includes a timestamp display and buttons for setting and displaying when a pet was last walked, fed, and/or administered medication.

FIG. 16 is a perspective view of a tenth embodiment of a signaling device 1000 according to the invention wherein the housing is in the shape of a dog bone and the device includes a timestamp display 1062 and buttons, 1056, 1058, 1060, for setting and displaying when a pet was last walked, fed, and/or administered medication. Like the ninth embodiment, discussed above, this embodiment includes a slidable timer control 1022 that slides from one setting to the next, instead of a dial, such as the one shown in FIG. 5. By pressing button 1056, timestamp display 1062 displays the last time the pet was walked. If button 1058 is pressed, timestamp display 1062 shows the last time the pet was fed. Similarly, if button 1060 is pressed, timestamp display shows when the pet was last given medication. Upon walking, feeding, or medicating the pet, the caregiver presses the corresponding button and holds it for four seconds. When one of buttons 1056, 1058, and 1060 is held for four seconds, the corresponding timestamp for walking, feeding, or administering medication is set to the current time and is displayed on the timestamp display 1062 the next time the associated button is pressed. The timestamp display 1062 may include light emitting diodes ("LEDs"), a liquid crystal display ("LCD"), or any other means capable of displaying a timestamp.

Figure 17:
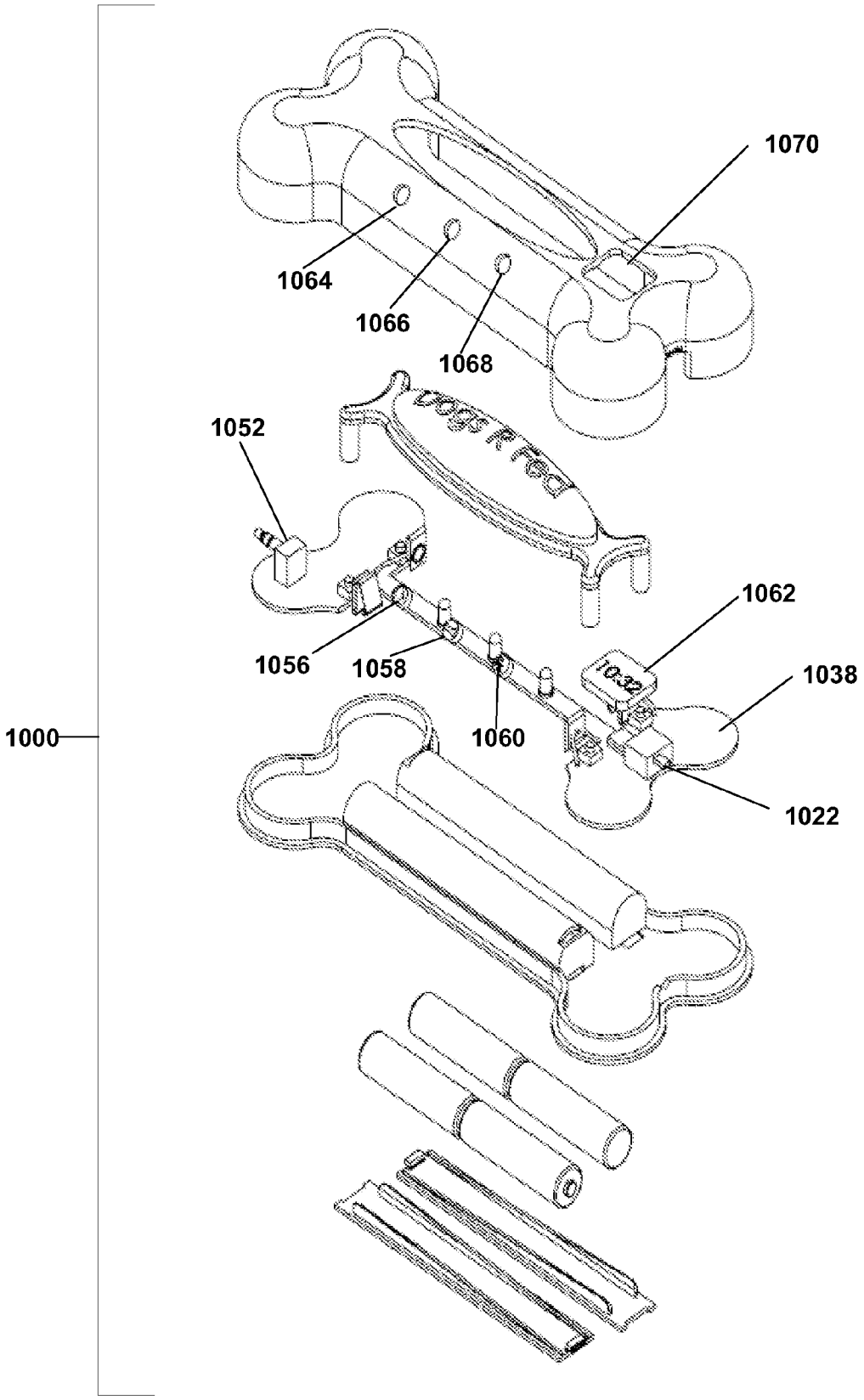
FIG. 17 is an exploded perspective view of a tenth embodiment of a signaling device according to the invention wherein the housing is in the shape of a dog bone and the device includes a timestamp display and buttons for setting and displaying when a pet was last walked, fed, and/or administered medication.

FIG. 17 is an exploded perspective view of the tenth embodiment of a signaling device 1000 according to the invention wherein the housing is in the shape of a dog bone. The device 1000 includes a timestamp display 1062 and buttons 1056, 1058, 1060 for setting and displaying when a pet was last walked, fed, and/or administered medication. The top face of the device 1000 includes an opening 1070 for the timestamp display 1062, as well as an opening 1064 for the walk button 1056, an opening 1066 for the food button 1058, and an opening 1068 for the medication button 1060. Also visible is external power receiver 1052, which allows the device 1000 to accept power from an external plug, such as an AC adaptor, if battery power is unavailable, either because the batteries are not present or have insufficient charge. As with previously-discussed embodiments, the electrical components are connected to a circuit board 1038.

Figure 18:
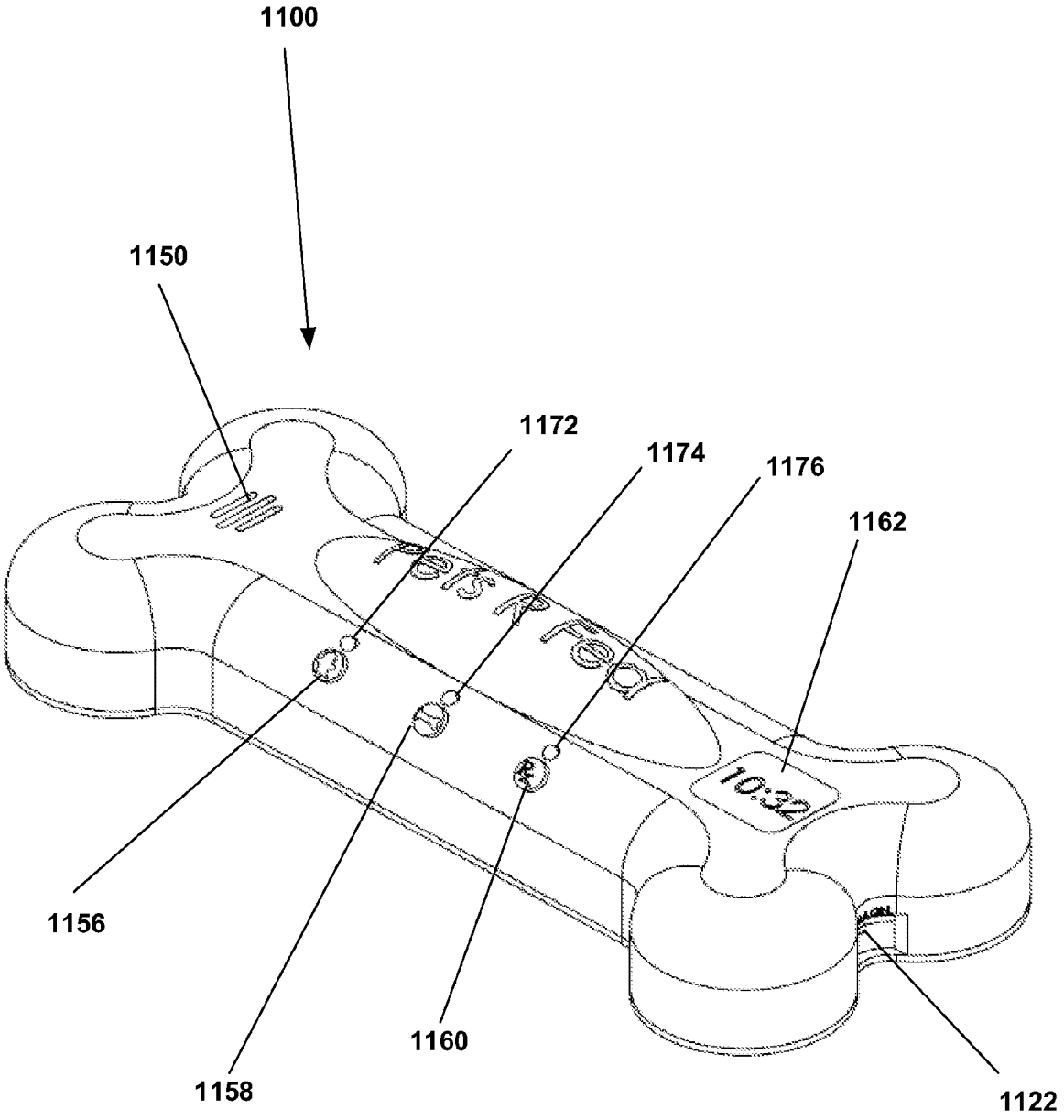
FIG. 18 is a perspective view of an eleventh embodiment of a signaling device according to the invention wherein the housing is in the shape of a dog bone and the device includes an audible alarm, a timestamp display, buttons for setting and displaying when a pet was last walked, fed, and/or administered medication, and corresponding LEDs for visually notifying a caretaker when a pet is scheduled to be fed, walked, and/or administered medication.

FIG. 18 is a perspective view of an eleventh embodiment of a signaling device 1100 according to the invention wherein the housing is in the shape of a dog bone and the device includes an audible alarm, a timestamp display 1162, buttons 1156, 1158, 1160, for setting and displaying when a pet was last walked, fed, and/or administered medication. Also included are corresponding light-emitting diodes ("LEDs") 1172, 1174, 1176 for visually notifying a caretaker when a pet is scheduled to be walked, fed, and/or administered medication. The top face of the device 1100 includes slots 1150 through which sound from the audible alarm emanates when the audible alarm is activated. In this embodiment, timer control 1122 is a slidable switch instead of a dial.

Figure 19:
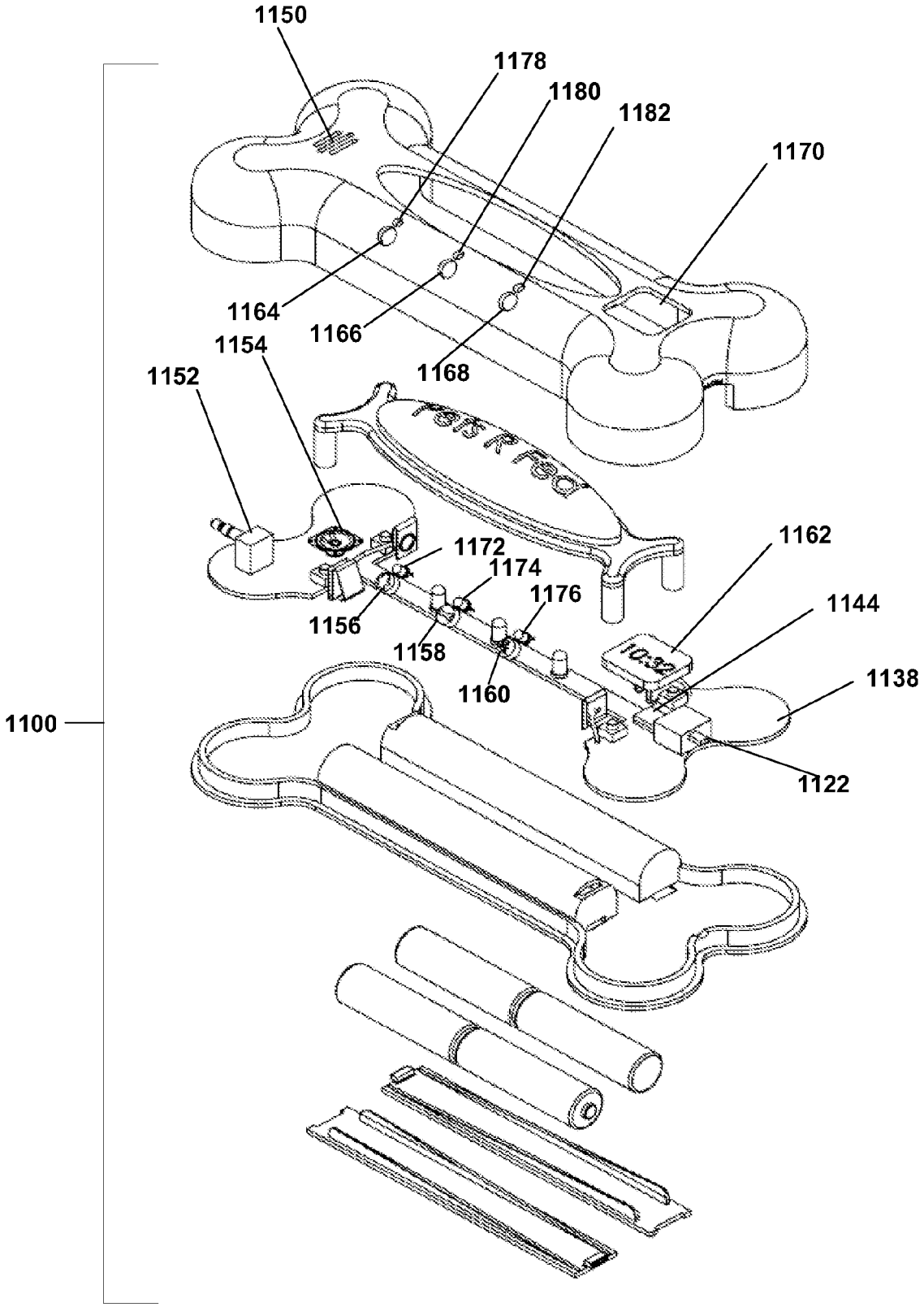
FIG. 19 is an exploded perspective view of an eleventh embodiment of a signaling device according to the invention wherein the housing is in the shape of a dog bone and the device includes an audible alarm, a timestamp display, buttons for setting and displaying when a pet was last walked, fed, and/or administered medication, and corresponding LEDs for visually notifying a caretaker when a pet is scheduled to be fed, walked, and/or administered medication.

FIG. 19 is an exploded perspective view of the eleventh embodiment of a signaling device 1100 according to the invention, wherein the housing is in the shape of a dog bone. The device 1100 includes an audible alarm 1154, a timestamp display 1162, buttons 1156, 1158, and 1160 for setting and displaying when a pet was last walked, fed and/or administered medication, and corresponding LEDs 1172, 1174, and 1176 for visually notifying a caretaker when a pet is scheduled to be walked, fed, and/or administered medication. Timer control 1122 sets the interval between each walking, feeding, and/or administering of medication to the pet. By pressing and holding the food button 1158 for a predetermined time, preferably three seconds, then adjusting the timer control to an interval setting, the interval between feedings for the pet is set. Similarly, reproducing the same steps with the walk button 1156 and the medication button 1160 will set the corresponding time intervals for walking and administering medication to the pet. Quickly pressing and releasing any of the three buttons, 1156, 1158, and 1160, will cause the timestamp display 1162 to display the last time the pet was walked, fed, or given medication, according to which button was pressed.

The front face of the device 1100 includes slots 1150 through which sound from the audible alarm 1154 emanates when the audible alarm is activated by microchip 1144 to notify a caretaker to walk, feed, and/or give medication to the pet. Also included in the front face of the device 1100 are openings 1164, 1166, 1168 for the walk button 1156, food button 1158, and medication button 1160 respectively. The front face also includes openings 1178, 1180, and 1182 for LEDs 1172, 1174, and 1176, respectively. Also visible is external power receiver 1152, which allows the device 1100 to accept power from an external plug, such as an AC adaptor, if battery power is unavailable. As with previously-discussed embodiments, the electrical components are connected to a circuit board 1138.

Figure 20:
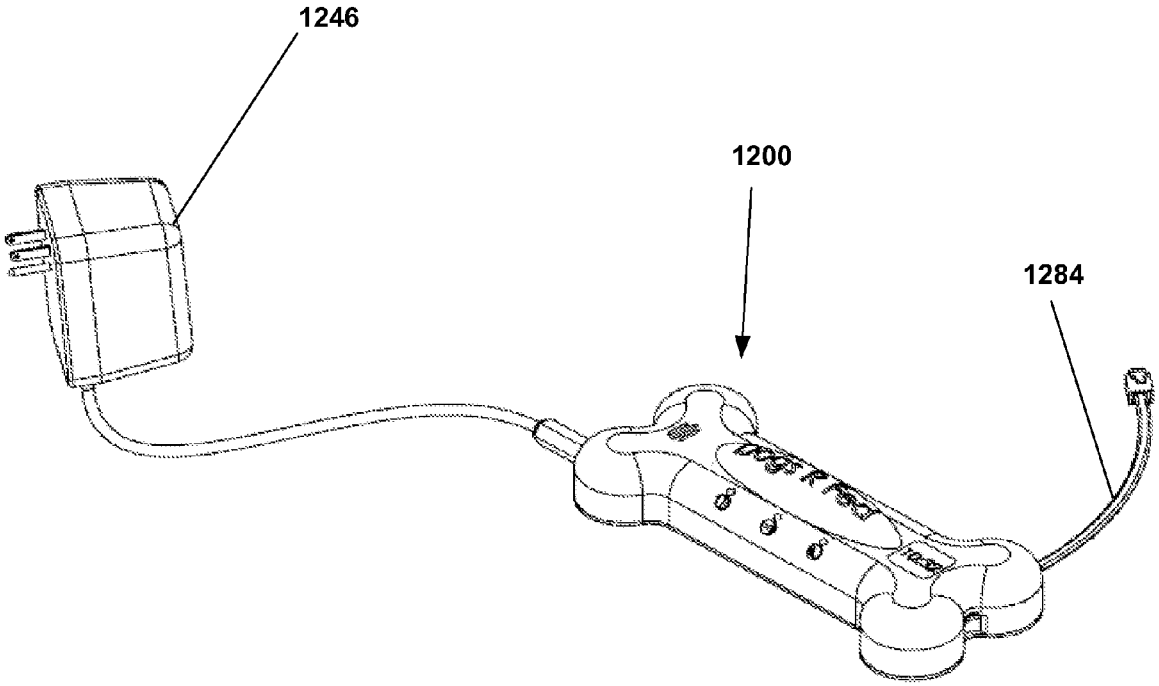
FIG. 20 is a perspective view of a twelfth embodiment of a signaling device according to the invention wherein the housing is in the shape of a dog bone and the device includes an audible alarm, a timestamp display, buttons for setting and displaying when a pet was last walked, fed, and/or administered medication, corresponding LEDs for visually notifying a caretaker when a pet is scheduled to be fed, walked, and/or administered medication, and a phone line interface for alerting a caretaker by phone of the same.

FIG. 20 is a perspective view of a twelfth embodiment of a signaling device 1200 according to the invention wherein the housing is in the shape of a dog bone. The device 1200 includes an audible alarm, a timestamp display, buttons for setting and displaying when a pet was last walked, fed, and/or administered medication, and corresponding LEDs for visually notifying a caretaker when a pet is scheduled to be walked, fed, and/or administered medication. In these respects, the twelfth embodiment is identical to the eleventh embodiment, which is discussed above. As can be seen in FIG. 20, an AC adaptor 1246 connects to the device 1200 to provide power. Additionally, a phone line 1284 connects to the device 1200, as explained in more detail with reference to FIG. 21.

Figure 21:
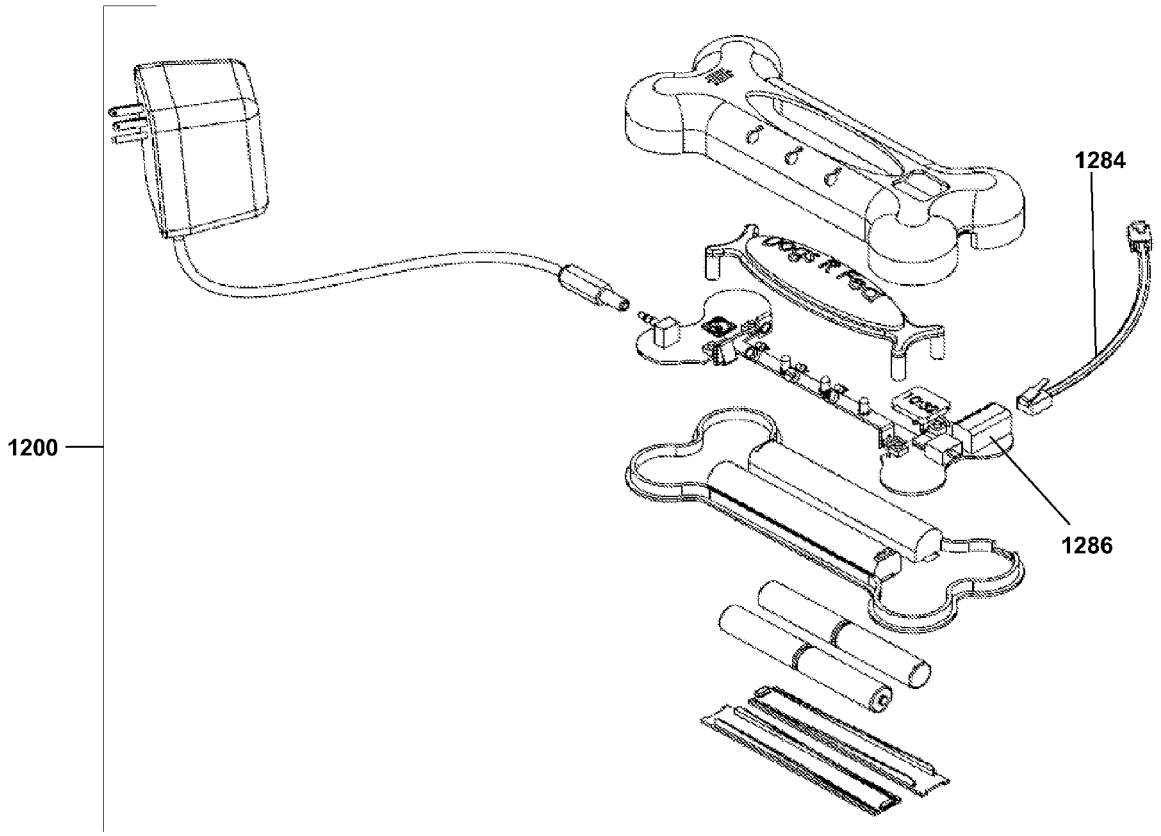
FIG. 21 is an exploded perspective view of the twelfth embodiment of a signaling device according to the invention wherein the housing is in the shape of a dog bone and the device includes an audible alarm, a timestamp display, buttons for setting and displaying when a pet was last fed, walked, and administered medication, corresponding LEDs for visually notifying a caretaker when a pet is scheduled to be walked, fed, and/or administered medication, and a phone line interface for alerting a caretaker by phone of the same.

FIG. 21 is an exploded perspective view of the twelfth embodiment of the signaling device 1200 according to the invention. As stated with reference to FIG. 20, the twelfth embodiment is identical to the eleventh embodiment in all respects, except as follows. The twelfth embodiment includes a phone line interface 186 which is shown connected to phone line 184. The phone line interface 186 allows the device 1200 to dial a phone number and deliver a verbal message that the pet needs to be walked, fed, and/or given medication, according to the schedule set by a caretaker. The phone call and verbal message occurs within a designated time, preferably thirty minutes, after the audible alarm and corresponding LED(s) have been activated and no action has been taken to notify the device 1200 that the pet has been walked, fed, and/or given medication according to schedule. In other embodiments, the phone line interface 186 may be substituted with a wired or wireless network interface and instead of a verbal message, the message may be sent in text, such as via email or short message service ("SMS").

While preferred embodiments of the disclosed subject matter have been described, so as to enable one of skill in the art to practice the present disclosed subject matter without undue experimentation, the preceding description is intended to be exemplary only. It should not be used to limit the scope of the disclosed subject matter.

The invention claimed is:

1. A signaling device for helping at least one caretaker maintain a feeding schedule for at least one pet, the signaling device comprising:

a housing having a front face;

a translucent button accessible at the front face of the housing;

a circuit board located within the housing;

a microchip located within the housing and connected to the circuit board;

at least one light emitting diode located within the housing and connected to the circuit board;

at least one push-button switch located within the housing and connected to the translucent button and the circuit board; and at least one timer control secured within the housing but accessible from outside the housing, the timer control being connected to the circuit board;

wherein the signaling device does not comprise a time of day display or an alphanumeric display;

and the housing has a shape selected from the group of a bone, cat, bird, fish, rabbit, rodent, horseshoe, or turtle; and wherein the microchip turns on the at least one light emitting diode according to a setting on the timer control.

2. The signaling device of claim 1, wherein the front face of the housing includes an opening and the translucent button is secured within the housing and fills the opening in the front face of the housing.

3. The signaling device of claim 1, wherein the translucent button includes a message, symbol, or markings relating to a type of pet or feeding of the pet.

4. The signaling device of claim 1, wherein the housing is of a shape of a type of pet.

5. The signaling device of claim 1, further comprising at least one battery compartment in the housing.

6. The signaling device of claim 1, further comprising an electrical plug connected to the circuit board.

7. The signaling device of claim 1, wherein the housing is opaque and made of plastic.

8. The signaling device of claim 1, wherein the timer control is a slidable switch.

9. The signaling device of claim 1, wherein the microchip turns off the at least one light emitting diode according to a setting on the timer control.

10. The signaling device of claim 1, wherein the microchip turns on or off the at least one light emitting diode when the translucent button is touched.

11. A signaling device for helping at least one caretaker maintain a feeding schedule for at least one pet, the signaling device comprising:

an opaque housing having a front face;

a translucent button accessible at the front face of the housing;

a controller at least one light emitting diode located within the housing and configured to light the translucent button;

at least one push-button switch located within the housing and connected to the translucent button; and a timer input;

controller is configured to light the at least one light emitting diode according to a pet feeding schedule;

wherein the housing is of a shape of one of the group including: a type of pet, a dog bone, or a horseshoe; and indicia indicating that the pet feeding schedule corresponds to the type of pet, a dog, or a horse.

12. The signaling device of claim 11, further comprising at least one battery compartment in the housing.

13. The signaling device of claim 11, further comprising an electrical port for receiving an electrical plug.

14. The signaling device of claim 11, wherein the signaling device's inputting system consists of the translucent button and a rotary input forming the timer input.

15. A signaling device for helping at least one caretaker maintain a feeding schedule for at least one pet, the signaling device consists:

an opaque housing having a front face;

a large translucent button accessible at the front face of the housing;

a controller and circuit board;

light emitting diode array comprising at least two light emitting diodes located within the housing and configured to light the translucent button according to a timing operation of the controller;

between one and four push-button switch located within the housing and operationally connected to the translucent button;

a rotary timer interval input; and a power source.

16. The signaling device of claim 15, wherein controller is configured to light the at least one light emitting diode according to a pet feeding schedule.

17. The signaling device according to one of claim 15 or claim 16, wherein the housing is of a shape of one of the group including: a type of pet, a dog bone, or a horseshoe.

18. The signaling device of claim 15, wherein the power source is a port receiving an alternating current wall plug external power source.

19. The signaling device of claim 15, wherein the power source is a battery and a port for receiving an external power source plug.

20. The signaling device of claim 15, wherein the rotary timer interval input sets a timer value in intervals of 2 hours according to the rotational position of the rotary timer interval input.

* * * * *